US009188110B2

(12) United States Patent
Roman et al.

(10) Patent No.: US 9,188,110 B2
(45) Date of Patent: Nov. 17, 2015

(54) BELLOWS BACKUP CHAMBER

(75) Inventors: Timothy S. Roman, Minnetonka, MN (US); Kurt R. Sjodin, Cedar, MN (US); Adam L. Kalthoff, Albany, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 322 days.

(21) Appl. No.: 13/643,360

(22) PCT Filed: Apr. 27, 2011

(86) PCT No.: PCT/US2011/034046

§ 371 (c)(1), (2), (4) Date: Oct. 25, 2012

(87) PCT Pub. No.: WO2011/137143

PCT Pub. Date: Nov. 3, 2011

(65) Prior Publication Data

US 2013/0039788 A1 Feb. 14, 2013

Related U.S. Application Data

(60) Provisional application No. 61/329,651, filed on Apr. 30, 2010.

(51) Int. Cl.

| | |
|---|---|
| ***F04B 15/00*** | (2006.01) |
| ***F04B 1/04*** | (2006.01) |
| ***F04B 43/08*** | (2006.01) |

(52) U.S. Cl.

CPC ..... *F04B 1/0448* (2013.01); *F04B 15/00* (2013.01); *F04B 43/08* (2013.01)

(58) Field of Classification Search

CPC ..... F04B 1/0448; F04B 43/08; F04B 15/00

USPC ..... 92/86, 165 R, 168

See application file for complete search history.

(56) References Cited

U.S. PATENT DOCUMENTS

| | | | | |
|---|---|---|---|---|
| 2,982,446 | A | 5/1961 | Pier | |
| 3,164,102 | A * | 1/1965 | Schmidt | 417/383 |
| 3,875,806 | A * | 4/1975 | Brewster | 74/18.2 |
| 4,463,663 | A * | 8/1984 | Hanson et al. | 92/168 |
| 4,556,369 | A * | 12/1985 | Braun | 417/437 |
| 5,145,339 | A | 9/1992 | Lehrke et al. | |
| 5,415,531 | A * | 5/1995 | Cavanaugh | 92/86 |

OTHER PUBLICATIONS

Graco Inc. Air-Powered Glutton Pumps Instructions-Parts List, #307843Z Revised Dec. 2003.

Binks 12:1 Exel Air Powered Pump manual, copyright 2006.

Binks Maple 15 Pump Instruction Manual, updated Oct. 18, 2012 considered prior art general knowledge.

Kremlin Flowmax Airmix Proportioning Pump Manual, Nov. 4, 2008 revision.

* cited by examiner

*Primary Examiner* — Thomas E Lazo
(74) *Attorney, Agent, or Firm* — Douglas B Farrow

(57) ABSTRACT

The pump (10) prevents fluid leaks when a bellows (12) ruptures in a pump incorporating a flexible bellows (12) as a primary seal and prevents fluid from leaking out of a pump (10) or the pump (10) ingesting air in the event of a bellows rupture. This is done by adding an additional seal (22) after the bellows and a large volume backup chamber 24.

1 Claim, 3 Drawing Sheets

BELLOWS BACKUP CHAMBER

TECHNICAL FIELD

This application claims the benefit of U.S. Application Ser. No. 61/329,651, filed Apr. 30, 2010, the contents of which are hereby incorporated by reference.

BACKGROUND ART

In a typical reciprocating piston pump such as that shown in FIGS. 1 and 2, there is a seal that separates the high pressure working fluid from the atmosphere surrounding the pump. Even in perfect condition, these seals can weep a small amount of fluid each cycle and this can be detrimental to seal life. The fluid can solidify or crystallize and be pulled back into the seal, shortening the seal life. Historically one way to deal with this small amount of leakage has been to use a flexible bellows seal, which creates a pump without an exposed sliding seal. In such designs, the inlet of the pump is routed past the high pressure seal and the resulting low pressure inlet chamber is sealed by the bellows which creates an air tight non-sliding seal.

As the pump reciprocates, the bellows changes volume and thus the side of the bellows not contacting the working fluid is usually vented to the atmosphere to prevent pressure from building up. The problem with this basic layout is that when the bellows fails as a result of various conditions including fatigue, over-pressurization, or excessive speed, it can cause a substantial exterior leak. This is especially true if there is a positive pressure in the inlet chamber. This does not happen with a normal sliding seal which usually fails in a very slow predictable fashion, versus a sudden rupture.

DISCLOSURE OF THE INVENTION

It is an object of this invention to prevent fluid leaks when a bellows ruptures in a pump incorporating a flexible bellows as a primary seal.

The instant invention prevents fluid from leaking out of a pump or the pump ingesting air in the event of a bellows rupture. Ideally, this allows the pump to continue operating for a period of time until it is convenient to shut down the pump and replace the bellows seal.

The instant invention rectifies the sudden rupture failure mode of the bellows by adding an additional seal after the bellows and a large volume backup chamber as shown in FIG. 3. The purpose of the seal and backup chamber is to contain the working fluid after the bellows ruptures for a finite amount of time. It also keeps the system sealed to prevent the pump from ingesting air and thus allowing the pump to continue running.

The backup seal above the bellows does not normally see the working fluid, which can be abrasive. This allows the seal to experience very little wear until the bellows fails, at which point it must start sealing against the working fluid. The chamber is sized such that the change in volume created by the bellows being compressed during normal operation does not cause an excessive swing in pressure.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
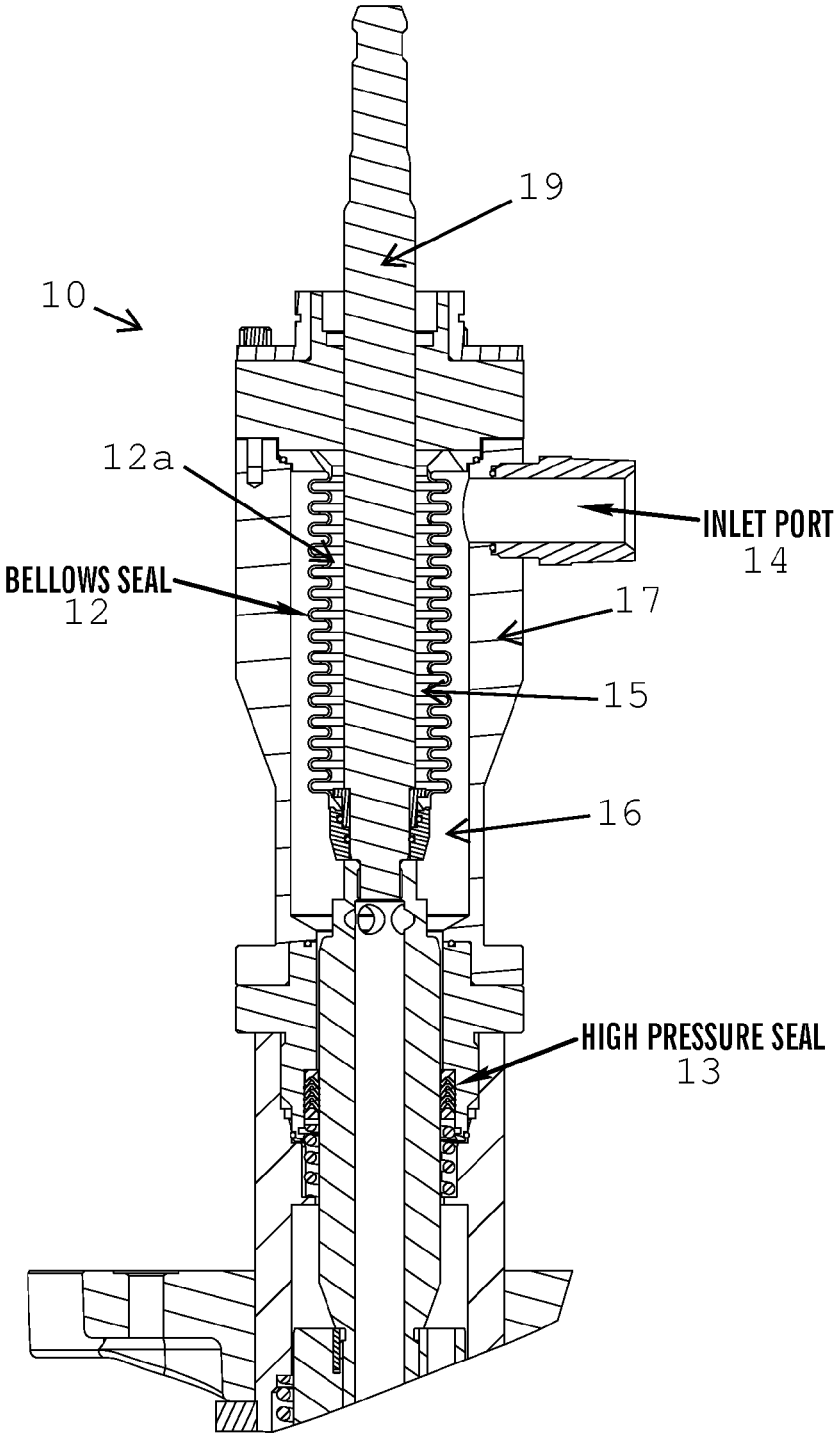
FIG. 1 is a cross-section of a prior art bellows pump showing the inlet port.
Figure 2:
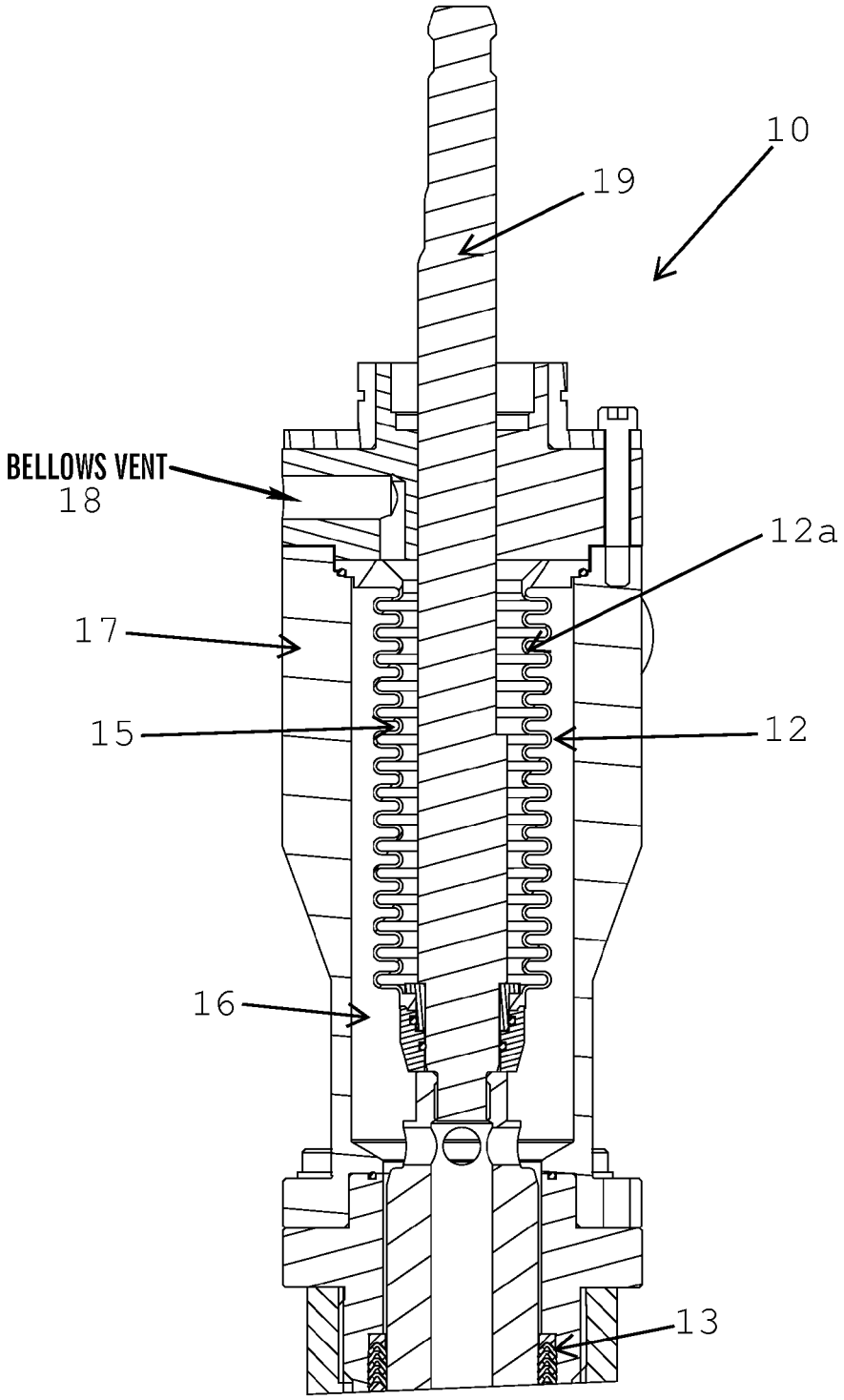
FIG. 2 is a cross-section of a prior art bellows pump showing the bellows vent.

In a known reciprocating piston pump 10 shown in FIGS. 1 and 2, one way to deal with leakage has been to use a flexible bellows seal 12, which creates a pump 10 without an exposed sliding seal on shaft 19. In such designs, the inlet 14 of the pump is routed past the high pressure seal 13 and the resulting low pressure inlet chamber 16 in housing 17 is sealed by the bellows 12 which creates an air tight non-sliding seal.

As the pump 10 reciprocates, the bellows 12 changes volume and thus the side 12*a* of the bellows 12 not contacting the working fluid (and forming an inner chamber 15) is usually vented to the atmosphere through bellows vent 18 to prevent pressure from building up.

Figure 3:
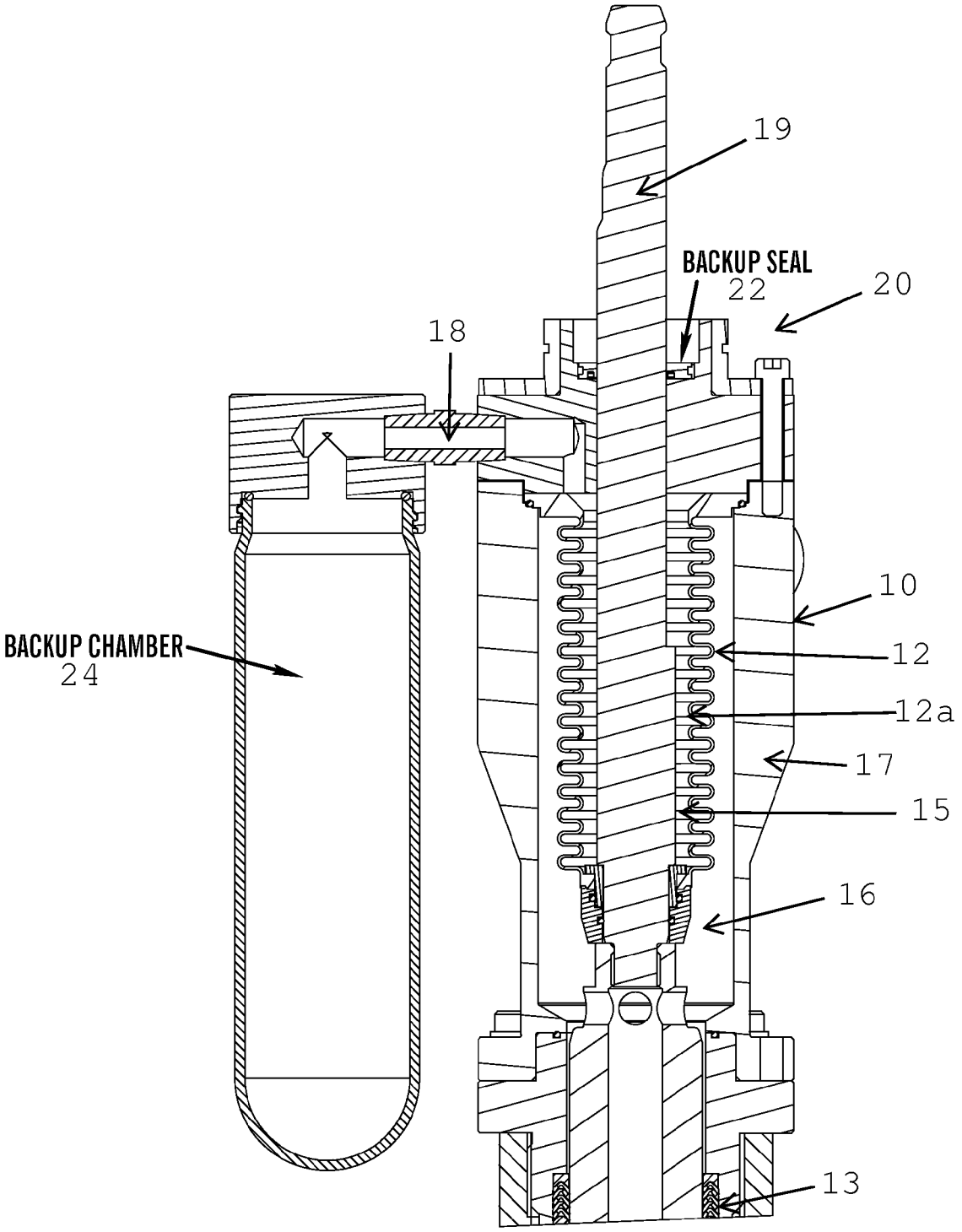
FIG. 3 is a cross-section of the bellows pump of the instant invention along a cross-section similar to that of FIG. 2.

The instant invention 20 shown in FIG. 3 prevents fluid from leaking out of a pump 10 or the pump 10 ingesting air in the event of a bellows 12 rupture. Ideally, this allows the pump to continue operating for a period of time until it is convenient to shut down the pump 10 and replace the bellows seal 12.

The instant invention rectifies the sudden rupture failure mode of the bellows 12 by adding an additional seal 22 after the bellows 12 and a large volume backup chamber 24 as shown in FIG. 3. The purpose of the seal 22 and backup chamber 24 is to contain the working fluid after the bellows 12 ruptures for a finite amount of time. It also keeps the system sealed to prevent the pump 10 from ingesting air and thus allowing the pump 10 to continue running.

The backup seal 22 above the bellows 12 does not normally see the working fluid, which can be abrasive. This allows the seal 22 to experience very little wear until the bellows 12 fails, at which point it must start sealing against the working fluid. The chamber 24 is sized such that the change in volume created by the bellows 12 being compressed during normal operation does not cause an excessive swing in pressure.

It is contemplated that various changes and modifications may be made to the bellows sealing system without departing from the spirit and scope of the invention as defined by the following claims.

The invention claimed is:

1. In a reciprocating piston pump having a bellows vent, a housing, a flexible bellows seal around a shaft slideable in said housing in a first chamber to create an air tight non-sliding seal, the first chamber being a low pressure inlet chamber, the improvement comprising:

a seal in said housing slideably sealing said shaft wherein said seal restricts leakage due to bellows seal failure which enters the area formed between said shaft and said bellows seal; and a second chamber connected to and in permanent communication with said bellows vent and is closed to the surrounding air.

* * * * *